US005255696A

United States Patent [19]

Leonard

[11] Patent Number: 5,255,696

[45] Date of Patent: Oct. 26, 1993

[54] WALKER RELEASE BUTTON

[75] Inventor: Frederic Leonard, Summit, N.J.

[73] Assignee: Diamond Medical Equipment Corp., Mount Vernon, N.Y.

[21] Appl. No.: 702,614

[22] Filed: May 17, 1991

[51] Int. Cl.[5] ..... A61H 3/00

[52] U.S. Cl. ..... 135/67; 135/74; 297/5; 482/66

[58] Field of Search ..... 135/65, 67, 74; 272/70.3, DIG. 9; 297/5-7

[56] References Cited

U.S. PATENT DOCUMENTS

| | | | |
|---|---|---|---|
| 3,442,276 | 5/1969 | Edwards et al. | 135/67 |
| 3,658,079 | 4/1972 | Block | 135/67 |
| 3,688,789 | 9/1972 | Bunch | 135/67 |
| 3,945,389 | 3/1976 | Smith | 135/67 |
| 3,993,088 | 11/1976 | Thomas | 135/67 |
| 4,180,086 | 12/1979 | Thomas | 135/67 |
| 4,298,016 | 11/1981 | Garelick | 135/74 X |
| 4,518,002 | 5/1985 | Battison, Sr. et al. | 135/67 |
| 4,640,301 | 2/1987 | Battiston, Sr. et al. | 135/67 |
| 4,830,035 | 5/1989 | Liu | 135/67 |

*Primary Examiner*—Carl D. Friedman
*Assistant Examiner*—Lan M. Mai
*Attorney, Agent, or Firm*—Ostrolenk, Faber, Gerb & Soffen

[57] ABSTRACT

A collapsible walker for elderly and disabled persons including first and second U-shape side frames which are pivotal relative to a front frame, enabling the walker to be collapsed substantially flat. At each corner between the front and side frames, a corner brace is provided in the form of a plastic sleeve which rides/slides on a horizontal rib in the side frame and a connecting rod which connects the sleeve to the front frame A detent in the sleeve snaps into catch slots in the horizontal rib to lock the walker in an open position. A pushbutton on the sleeve permits disengaging the detent from the catch slot.

19 Claims, 4 Drawing Sheets

10
12
14
18
20
22
24
26
28
32
40
42
50
52
54
56
58
60
62
64
66
68
70
76
D 80
82
86
87
84
12
20
72
76
26
64
48
74
42
40
70
18
44
46
28
30

WALKER RELEASE BUTTON

BACKGROUND OF THE INVENTION

The present invention relates to a collapsible walker for elderly and disabled individuals and, more particularly, relates to a locking device in the form of an integral locking mechanism and release button for locking the side frames of the walker in an open position.

Walkers are a necessity to many elderly and disabled individuals and must accompany them wherever they go. Therefore, walkers must be capable of being folded to a flat position to facilitate their shipment or storage. Since folding or unfolding of a walker will likely have to be accomplished by the disabled person, without outside assistance, the folding mechanism should be easily operable even by the elderly or disabled whose muscular coordination might be impaired. For example, walkers should be constructed to enable the elderly and disabled to maneuver themselves and their walkers into and out of automobiles. A cumbersome mechanism for folding and unfolding a walker might limit its range of usefulness.

An essential requirement for a walker is that it provide firm support for the user. An elderly or disabled person using the walker may have a poor sense of equilibrium and a genuine fear of falling. Given these circumstances, nothing can be more unnerving than a walker which feels unstable. Collapsible walkers frequently develop a certain feeling of looseness at joints or pivot points resulting from the constant folding and unfolding of the walker. Therefore, it is desirable to provide collapsible walkers which do not develop looseness through continued usage.

The foregoing objectives have been tackled by the prior art as exemplified by several U.S. Pat. Nos. Thus, U.S. Pat. No. 4,180,086 describes a walker 10 that can be locked in a normal open position by a tubular telescoping locking means 32. The locking means consists of a first tube 54 which telescopes and is received by a second outer tube 52, with one of the tubes being connected to the front cross-rib 14 and the other to the rear leg of the side frame of the walker.

One of the tubes includes an aperture which guides and contains the head of a pushbutton. The second tube includes apertures 55 and 56 which are adapted to receive and lock a pushbutton 58. A palm pusher 44 operates, in the manner described in U.S. Pat. No. 4,056,115, to displace the locking pushbutton from the aperture to permit the two tubes to slide relative to one another to position the walker.

In U.S. Pat. No. 3,945,389, the locking means are comprised of corner ribs, each of which includes a plate member 46 and which, as shown in FIGS. 5–7, is pivotally supported with respect to one of the upper ribs by a pivot pin 48. A guide pin 50 engages a guide slot in the plate member 46. A plastic washer 60 pressed against the plate member provides frictional resistance to sliding. To lock the walker in its closed or open position, the corner ribs are interlocked with the cross-rib 4 by means of a detent 62 that has a head 63 that extends through an aperture 68 in the upper surface of a transverse member 12. The detent 62 is biased to an upward position by a spring 66.

Additional collapsible walker embodiments are described in U.S. Pat. Nos. 3,442,276; 3,658,079; 3,783,886; and 3,688,789.

In the case of the aforementioned No. 4,180,086 patent, the comparatively long telescoping tubes are more susceptible to develop a resistance to sliding and more prone to jamming The general construction thereof is mere complex and less sturdy. In the locking arrangement of United States Patent 3,945,389, the construction of the locking mechanism is similarly more prone to jamming and is constructed of numerous parts, adversely affecting long term reliability and operability. Moreover, the guide slot in the plate member is susceptible of catching clothing, such as the sleeve, of the user, or even a finger, and is thus liable to cause injury.

The general trend in the medical field is on reducing cost and increasing reliability of medically related equipment in order to contain the upwardly spiraling costs of medicine in the U.S.

SUMMARY OF THE INVENTION

Accordingly, it is an object of the present invention to provide a collapsible walker that is sturdy and wobble-free in its normal open position, even after continued usage.

It is a further object of the present invention to provide a collapsible walker having a locking mechanism that is simple and inexpensive in construction and reliable and easy to use.

It is another object of the present invention to provide a walker locking mechanism that is mechanically simple with a minimal number of working parts.

In realizing the foregoing and other objects, the present invention provides a collapsible walker which is in its overall aspects conventional insofar as it is comprised of first and second U-shaped side frames that are connected together by a forwardly located cross-brace or front frame. The front legs of each of the side frames pass through a sleeve that forms a bearing to which the cross-rib is welded or otherwise secured, in a fashion that enables the side frames to be folded toward the front frame to flatten the walker to facilitate its storage and transportation.

A corner brace which forms a locking mechanism extends from each side frame to the front frame. Each corner brace includes a plastic sleeve that is slidable on an upper, horizontally extending reinforcing rib of the side frame, and a connecting bar that is pivotally connected at its opposed ends to the front frame and to the sleeve. In operation, as the side frame is moved between a closed and open position, the sleeve rides horizontally and is guided along the reinforcing rib.

In accordance with a salient feature of the present invention, formed within the sleeve is a detent which is biased to bear against the rib and to snap into a strategically located slot or catch in the rib so as to lock the sleeve and secure the walker in the open position. Optionally, an additional catch is provided in the rib to lock the side frame in the closed position of the walker.

An integrally formed portion of the sleeve defines a pushbutton which can be simply and easily grasped and depressed by the user, to force the detent out of the catch when it is desired to further readjust the walker.

Other features and advantages of the present invention will become apparent from the following description of the invention which refers to the accompanying drawings.

DETAILED DESCRIPTION OF THE DRAWINGS

Figures 1, 6, 7, 8, 9, 10:
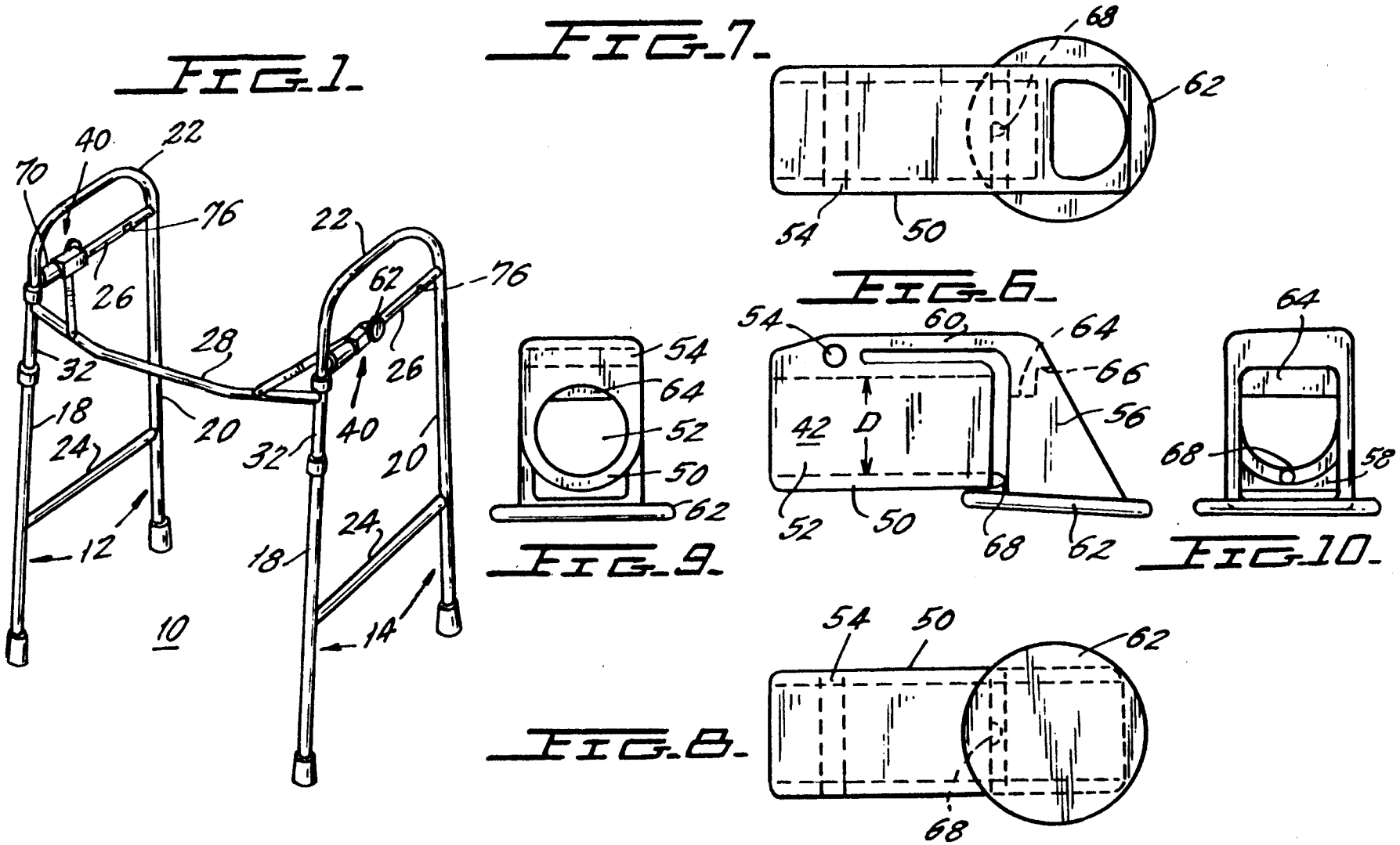
FIG. 1 is perspective of a collapsible walker in accordance with the present invention.
FIG. 6 illustrates a walker locking device in accordance with the present invention.
FIG. 7, 8, 9 and 10 are, respectively, top, bottom, rear and front views of the device of FIG. 6.

Referring to the drawings, the walker 10 of the present invention essentially comprises, as shown in FIG. 1, left and right U-shaped side frames 12 and 14, each including a front leg 18, a rear leg 20, and a curved upper section 22 extending from and connecting the legs 18 and 20. Hand grips (not shown) may be provided on the upper section 22.

The front and rear legs 18 and 20 are reinforced by a lower strut 24, an additional cylindrical rib 26 extending between the front and rear legs 18 and 20 directly below the upper section 22. Besides reinforcing the legs 18 and 20, the rib 26 provides a sliding surface for a locking mechanism to be described.

Figure 4:
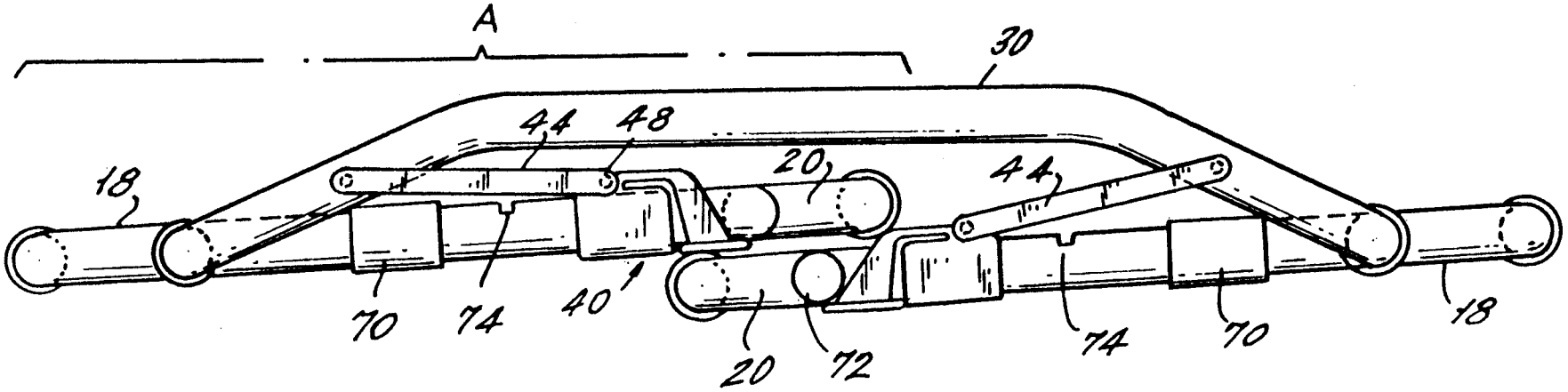
FIG. 4 is a top view of the walker with both side frames shown in the closed position.
Figure 3:
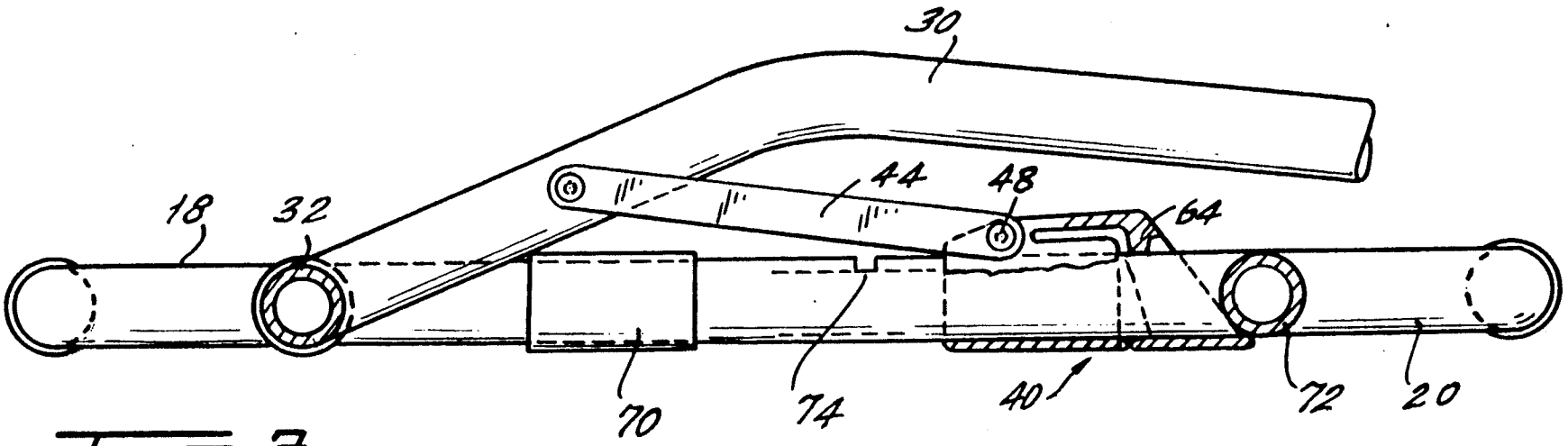
FIG. 3 is a top view illustrating the left side frame in its closed position.
Figure 5:
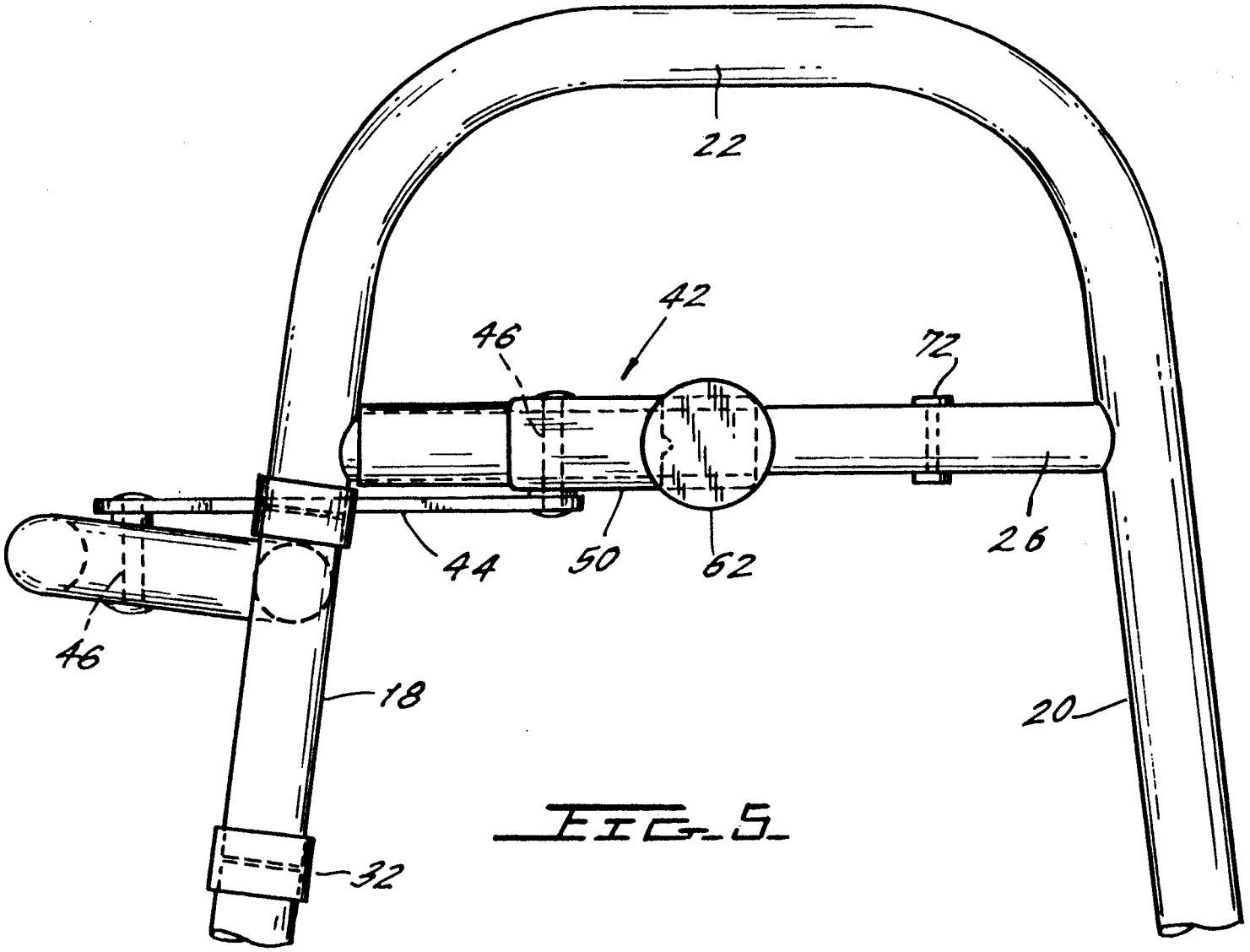
FIG. 5 is a side view of the walker of the present invention.

A front brace or frame 28 comprises a bar 30 connected at its ends to a pair of sleeves or bearings 32, the bearings being rotatably arranged on the front legs 18. The bearings 32 enable the left and right side frames 12 and 14 to fold toward or away from the front frame 28, enabling the walker 10 to assume an open position (shown in solid lines in FIG. 2), pass through an intermediate position (shown in broken lines in FIG. 2), and assume a fully closed position as shown in FIG. 4. FIG. 3 is an enlargement of the portion "A" in FIG. 4.

The focus of the present invention is on a locking mechanism 40 (FIG. 2) by which the walker 10 can be locked in the open position in a sturdy, wobble-free and exceedingly simple-to-construct and use manner. Essentially, the mechanism 40 consists of a single, integrated plastic locking sleeve 42 that is configured to slide on the upper rib 26 and of a metallic connecting rod 44 that is connected by a first pivot 46 to the front frame 28 and by a second pivot 48 to the slidable sleeve 42. Preferably, the plastic locking sleeve 42 is constructed of Delrin 500 plastic.

With particular reference to FIG. 6–10, it will be noted that the locking sleeve 42 has a sleeve body 50 with an axially extending bore 52 of a diameter D sized to enable the sleeve body 50 to tightly fit around while sliding without excessive friction on the rib 26. The aperture 54 receives the second pivot 48 (FIG. 2).

The locking sleeve 42 is formed by injection molding together with an integral lock 56 that has a generally square-shaped through-going opening 58 and a resilient bar portion 60 connecting the sleeve body 50 and the lock 56 to one another. The lock 56 can be flexed open, by pressing on the pushbutton 62, upwardly from the perspective of FIG. 6. The pushbutton 62 can be shaped elliptical, rectangular, circular or the like.

Figures 2, 11, 12:
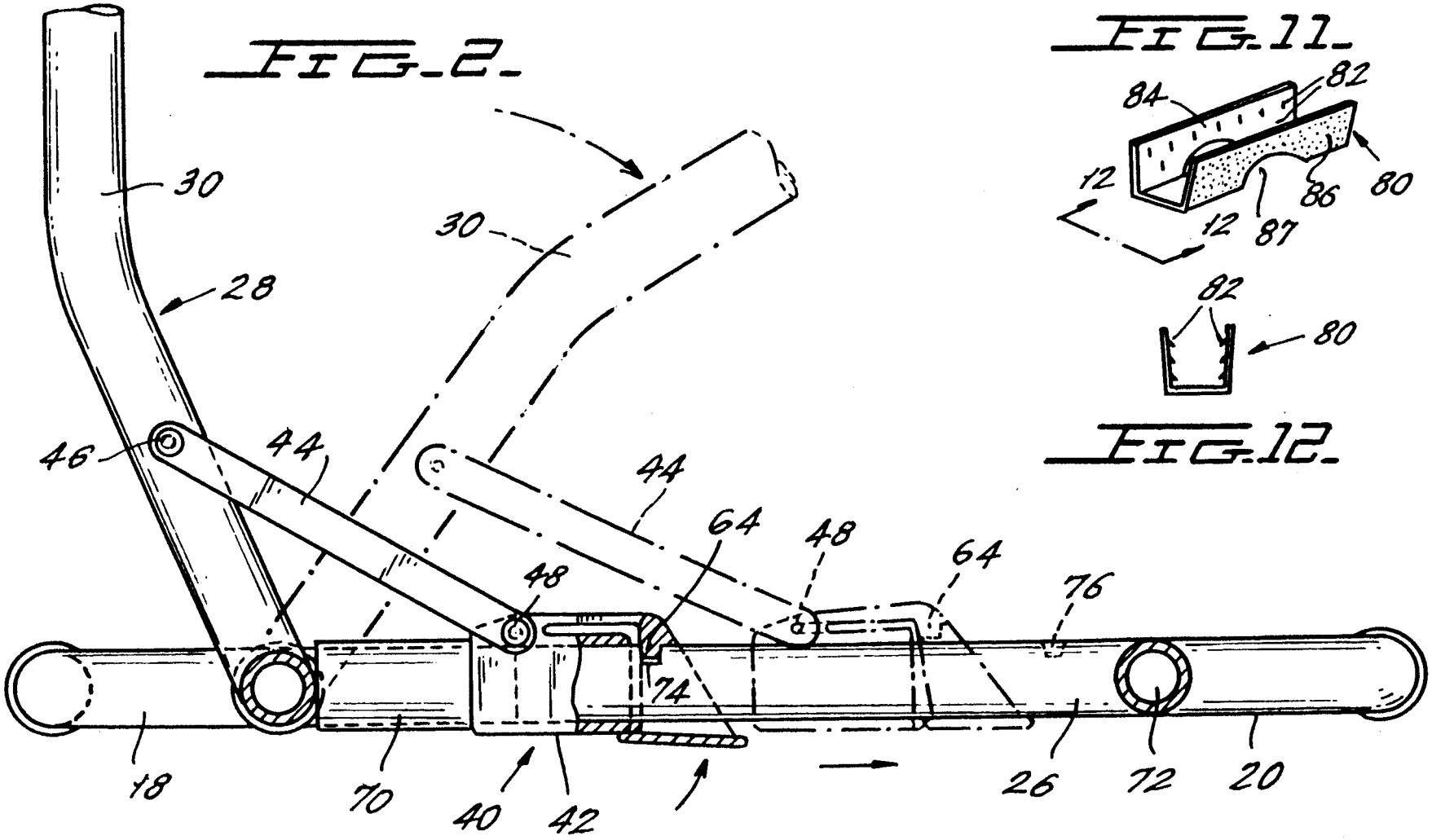
FIG. 2 is top view of a portion of the walker of FIG. 1, illustrating the device in an open position, and in a partially closed position (broken lines).
FIG. 11 illustrates a metallic cover for a detent which is incorporated in the device of FIG. 6.
FIG. 12 is a side view in the direction of lines 12—12 of the device of FIG. 11.

A detent 64 projects down from the roof 66 of the lock 56, into the path of the axial bore 52 of the sleeve body 50, when the lock 56 is in its unflexed position (FIG. 2). A portion of the sleeve body 50 extends toward and forms a stop 68 that prevents the lock 56 from approaching too close to the sleeve body 50.

In the preferred embodiment of the locking sleeve 42, all the constituent parts of the sleeve 42 are formed as the single piece, integrally molded device shown in FIG. 6.

In the fully assembled walker 10, the plastic locking sleeve 42 is slidable on the rib 26, between a front stop 70 and a rear stop 72 (FIGS. 2–5). These stops 70 and 72 may be constructed as plastic or aluminum sleeves disposed on the rib 26, or as pins which penetrate through the rib 26.

The hollow rib 26 is cut over a small portion of its circumference defining a first slot or catch 74 (FIGS. 3 and 4), at a location on the rib 26 which will cause the detent 64 to snap into the catch 74 and lock the walker 10 in its open position. Preferably, the cross-sectional width of the detent 64 (measured along the length dimension of the rib 26) tapers down in size, so that in the event that the width of the catch 74 enlarges due to wear, the detent 74 will penetrate deeper into the catch 74 and still hold the side frames 12 and 14 tight and wobble-free relative to the front frame 28.

Reference numeral 76 shows an optional, additional catch located more rearwardly on the rib 26 and adopted to lock the walker 10 in its closed position.

Since repeated use of the locking mechanism 40 might cause the plastic detent 64 to wear off or break, the present invention also contemplates providing an optional protective cover 80 in the shape of a trough, as shown in FIG. 11. The cover 80 has a cross-sectional shape as shown in FIG. 12 and downwardly oriented teeth 82 on its interior surfaces 84. Thereby, when the cover 80 is pushed atop the detent 64, it will bite into it and assure that any attempt to remove the cover will cause its teeth 82 to bite deeper and more firmly secure it against removal. The outer surfaces 86 of the cover 80 are optionally roughened to increase their frictional hold on the rib 26.

The arcuate cutout 87 in the bottom of the cover 80 serves to enable the plastic material of the detent 64 to slide against the surface of the rib 26, rather than the metal of the cover, preventing scoring/scratching of the rib 26.

The locking sleeve 42 preferably has a length on the order of about two inches, whereby it is configured to easily slide between the locked and unlocked positions. As is obvious from the drawings, the locking sleeve 42 is substantially shorter than the rib 26 on which it slides and, further, the sleeve 42 is always fully disposed on the rib 26, somewhere between the front and rear legs 18 and 20.

In operation, to collapse the walker 10, the feeble, elderly or disabled person need do no more than press the pushbutton 62 and swing the side frames 12 and 14 inwardly towards the front frame 28. Note that as the locking sleeve 42 slides along the rib 26, the bottom surface of the detent 64 engages and rides against the surface of the rib 26 as shown in broken lines in FIG. 2.

Thus, the present invention succeeds in its key objective of providing an extremely simple and inexpensive injection molded part that solves the problem of providing a walker with a locking mechanism that will hold the walker in a sturdy and wobble-free manner, virtually through the entirety of the useful life of the walker.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. walker, comprising:

a left side frame and a right side frame, each side frame having a generally vertically extending front leg and a generally vertically extending rear leg and a horizontally extending upper rib connected at one end thereof to said front leg and at another end thereof to said rear leg, said upper rib having a detent catch therein;

a front frame pivotally connected on opposed ends thereof to the left and right side frames, in a manner that enables the side frames to be moved between closed and open positions;

a first and a second corner brace connected respectively between the front frame and the left and right side frames;

each said corner brace including:

a locking sleeve slidable on the upper rib, said locking sleeve being substantially shorter than said upper rib and fully disposed thereon between said front leg and said rear leg;

a detent in the locking sleeve and biased to snap into the catch formed in the upper rib; and a connecting rod connecting the locking sleeve to the front frame.

2. The walker of claim 1, wherein the detent is integrally formed with the locking sleeve.

3. The walker of claim 2, wherein the locking sleeve is constructed of plastic material.

4. The walter of claim 3, wherein the locking sleeve includes a sleeve body and a lock and the detent is disposed in the lock.

5. The walker of claim 4, further comprising a resilient bar connecting the sleeve body and the lock, the sleeve body, lock and resilient bar being integrally formed.

6. The walker of claim 5, including a pushbutton on the lock.

7. The walker of claim 5, further comprising an axial bore in the sleeve body, the axial bore having a shape and size which match the cross-sectional size of the upper rib.

8. The walker of claim 5, wherein each of the side frames has a general U-shape.

9. The walker of claim 8, each of the side frames comprising an upper portion extending from the front leg to the rear leg and providing a location for a hand grip.

10. The walker of claim 5, including a first stop on the upper rib, between the rear leg and the locking sleeve to provide a maximum opening position for the walker.

11. The walker of claim 10, further comprising a second stop on the upper rib, between the front leg and the locking sleeve.

12. The walker of the claim 5, wherein the resilient bar is constructed to urge the detent in the lock to a position at which it will be located in the space defined by he axial projection of the axial bore of the sleeve body toward the lock.

13. The walker of claim 1, wherein the connecting rod of each corner brace is metallic.

14. The walker of claim 1, further comprising a metallic detent cover for the detent 15. The walker of the claim 14, wherein the metallic cover has a cross-sectional shape which tapers in size from an upper to a lower region of the cover.

16. The walker of claim 15, wherein the metallic cover has on inside surfaces thereof downwardly projecting teeth for biting into the detent.

17. The walker of claim 16, wherein outer surfaces of the metallic cover are roughened to increase the frictional engagement between the cover and the upper rib.

18. The walker of claim 14, wherein the metallic cover has a cutout enabling contacting of the upper rib by the detent.

19. A walker, comprising:

a left side frame and a right side frame, each having a respective detent catch formed therein;

a front frame pivotally connected on opposed ends thereof to the left and right side frame, in a manner that enables the side frames to be moved between closed and open positions;

a first and a second corner brace connected respectively between the front frame and the left and right side frames;

each said corner brace including:

a locking sleeve slidable on a portion of a respective one of said side frames;

a detent in the locking sleeve biased to snap into the detent catch; and a connecting rod connected at one end thereof to the locking sleeve and at another end thereof to said front frame.

* * * * *